US006205227B1

(12) United States Patent
Mahoney et al.

(10) Patent No.: US 6,205,227 B1
(45) Date of Patent: Mar. 20, 2001

(54) PERITYMPANIC HEARING INSTRUMENT

(75) Inventors: Derek Dwayne Mahoney, Manalapan; Marvin Allan Leedom, Princeton, both of NJ (US); John Michael Margicin, Levittown; Walter Paul Sjursen, Washington Crossing, both of PA (US)

(73) Assignee: Sarnoff Corporation, Princeton, NJ (US)

( * ) Notice: Subject to any disclaimer, the term of this patent is extended or adjusted under 35 U.S.C. 154(b) by 0 days.

(21) Appl. No.: 09/105,729

(22) Filed: Jun. 26, 1998

Related U.S. Application Data

(60) Provisional application No. 60/073,288, filed on Jan. 31, 1998.

(51) Int. Cl.[7] ..... H04R 25/00
(52) U.S. Cl. ..... 381/328; 381/322
(58) Field of Search ..... 381/312, 380, 381/381, 328, 330, 322, 324, 325, FOR 133, FOR 135, FOR 138

(56) References Cited

U.S. PATENT DOCUMENTS

| | | | | |
|---|---|---|---|---|
| 2,487,038 | | 11/1949 | Baum | 181/23 |
| 3,527,901 | | 9/1970 | Geib | 179/107 |
| 4,870,688 | * | 9/1989 | Voroba et al. | 381/322 |
| 4,937,876 | * | 6/1990 | Biërmans | 381/324 |
| 5,046,580 | | 9/1991 | Barton | 181/135 |
| 5,201,008 | * | 4/1993 | Arndt et al. | 381/323 |
| 5,220,612 | | 6/1993 | Tibbetts et al. | 381/68 |
| 5,381,484 | * | 1/1995 | Claes et al. | 381/329 |
| 5,395,168 | * | 3/1995 | Leenan | 381/329 |
| 5,606,621 | * | 2/1997 | Reiter | 381/332 |
| 5,701,348 | * | 12/1997 | Shennib et al. | 381/322 |
| 5,712,917 | * | 1/1998 | Offutt | 381/328 |
| 5,875,254 | * | 2/1999 | Hanright | 381/329 |
| 5,979,589 | * | 11/1999 | Aceti | 381/328 |

FOREIGN PATENT DOCUMENTS

| | | |
|---|---|---|
| 3720591 | 7/1988 | (DE) . |
| 0 309 834 | 9/1988 | (EP) . |
| 0 310 866 | 9/1988 | (EP) . |
| 0 821 541 | 7/1997 | (EP) . |
| WO 92/13430 | 8/1992 | (WO) . |

* cited by examiner

*Primary Examiner*—Wing F. Chan
*Assistant Examiner*—P. Dabney
(74) *Attorney, Agent, or Firm*—Hamilton, Brook, Smith & Reynolds, P.C.

(57) ABSTRACT

A hearing instrument is adapted for positioning in the external auditory canal of a human proximal to the tympanic membrane. It includes a substantially rigid shell and a relatively flexible tip member. The tip member includes a hollow body portion defining a elongated passage for the communication of acoustic signals through the tip member. The hollow body portion of the tip member is sufficiently deformable so that an axis of the passage substantially conforms to an axis of the external auditory canal upon insertion. The hollow body is also significantly rigid to resist substantial collapse of the passage upon such insertion. The axis of the passage defined by the hollow body portion is moveable at an angle with respect to the axis of the shell so that the hearing instrument can navigate the canal during insertion. Wax guard and receiver mounting configurations as well as a method of assembly are also described.

25 Claims, 11 Drawing Sheets

PERITYMPANIC HEARING INSTRUMENT

This application claims the benefit under 35 U.S.C. 119 (e) of U.S. provisional application Ser. No. 60/073,288 filed Jan. 31, 1998.

FIELD OF THE INVENTION

The invention herein generally relates to a miniature electroacoustic instrument and, in particular, a peritympanic hearing instrument suitable for use in humans.

BACKGROUND OF THE INVENTION

Hearing instruments typically are custom-designed to suit the anatomical and audiological needs of an individual user. Because custom-made devices can be very costly, it is desirable to mass-produce a hearing instrument that is relatively inexpensive, readily adaptable to most users' anatomical and audiological requirements, and inconspicuous and lightweight.

There are significant challenges associated with the development of mass-produced hearing instruments. Although the structure of the external auditory canal generally is a sinuous, oval cylinder with three sections, it varies significantly depending on the particular individual. Traversing the canal towards the tympanic membrane, the first section is directed inward, forward, and slightly upward. The next section tends to pass inward and backward. The final section is carried inward, forward, and slightly downward. The outer portion of the ear canal is surrounded by cartilaginous tissue, with the inner portion being surrounded by bone. The canal is lined by a very thin lining of skin, which is extremely sensitive to the presence of foreign objects. Further details of the path and contours of the external auditory canal are described in U.S. Pat. No. 4,870,688, issued to Barry Voroba et al., and in U.S. Pat. No. 5,701,348, issued to Adnan Shennib, both of which are incorporated herein by reference.

U.S. Pat. No. 4,870,688 describes an in-the-canal miniaturized hearing aid contained within a prefabricated earshell assembly composed of a hollow rigid body with a soft, resilient covering fixed to its exterior. The microphone, receiver, amplifier, and battery are all wholly contained within a prefabricated modular sound assembly which snaps into a patient-selectable prefabricated earshell assembly. The soft, resilient covering that is affixed to the exterior of the rigid core is intended to allow the cylindrical or elliptical shape of the in-the-canal hearing aid to more easily conform to the individual variations in a user's auditory canal.

U.S. Pat. No. 5,701,348 describes a hearing device having highly articulated, non-contiguous parts including a receiver module for delivering acoustic signals, a main module containing all of the hearing aid components except the receiver, and a connector that is articulated with both the receiver module and the main module to permit independent movement of the receiver and main modules. Separation of the receiver from the main module, and the receiver's articulation with respect to the main module, is intended to provide at least two degrees of freedom in movement and independent movement of the receiver module with respect to the main module, and visa versa.

Attempts have also been made to provide inserts intended to be used as a part of a hearing aid device. U.S. Pat. No. 2,487,038, issued to Jasper Baum, describes an ear insert shaped for insertion into the concha or the outer cavity of an ear. It includes a series of ball-shaped ball-like wall sections each made with sufficiently thick walls so as to give them great stiffness and prevent substantial distortion of the cross-section of the sound-passage portions extending therethrough under the action of external bending forces when the insert is inserted into the curved space of the outer ear cavity. The ball-like wall sections are interconnected by short neck-like sections to readily flex and take up substantially the entire deformation to which the channel insert is subjected. Thin flexible, skirt-like protrusions project in outward and rearward directions from the ball-like wall sections to become wedged against the surrounding surface portions of the outer ear cavity for automatically establishing therewith an acoustic seal.

U.S. Pat. No. 3,080,011, issued to John D. Henderson, describes an ear canal insert with a very soft tip with mushroom-shaped flanges. A flexible mounting tube is considerably stiffer than the material of which the mushroom-shaped head portion flanges are formed so that it can be used to force the insert portion of the device into the ear canal.

U.S. Pat. No. 5,201,007, issued to Gary L. Ward et al., describes earmolds that convey amplified sound from the hearing aid to the ear. An acoustic conduction tube extends into the ear canal and a flanged tip on the conduction tube creates a resonant cavity between the tip and the tympanic membrane. The tip is constructed of a flexible material to form a sealed cavity adjacent the tympanic membrane, permit the seal to be obtained with only slight pressure against the wall of the ear canal, and permit the tip to be oscillated by the natural, unamplified sounds which arrive by air conduction through the ear canal, so that the oscillation can raise the resonant frequencies of the cavity.

Despite numerous attempts including those described above, there remains a need for a mass-produced hearing instrument that is relatively inexpensive, readily adaptable to an individual's atomical and audiological requirements, and that is inconspicuous and lightweight. It has been discovered that the development of a prosthetic device that occupies the region traditionally filled by an in-the-canal (ITC) device, as well as extending significantly into the peritympanic region, is improbable at best without a device that will allow deep penetration into the ear canal by the hearing instrument. Current "one-size-fits-all" hearing instruments are either of the in-the-ear (ITE) or ITC variety. Some have the ability to accommodate the first bend in the ear canal. However, conventional hearing instruments fail to adequately and simultaneously accommodate the first and second bends of a typical ear canal and are generally not capable of comfortably extending significantly into the peritympanic region.

It has also been recognized that hearing instruments typically have small-diameter openings, or sound ports, to let sound propagate from the receiver to the tympanic membrane. A common problem with such devices is that the cerumen, or wax, within the ear canal becomes embedded in the device's sound port. Physical properties of cerumen make it difficult to remove from the sound port and, indeed, the cleaning process may force the cerumen deeper into the sound port.

Cost is also a major consideration in the development of mass-produced hearing instruments. It has been discovered that, of all the components in a hearing instrument, the microphone and receiver (loudspeaker) are generally the most costly. Of these components, the receiver is generally the more costly item. Accordingly, reduction of the cost of the receiver component can significantly lower the cost of manufacturing the hearing instrument. Many receivers are considered to be self contained in that they are mounted within their own metal housing. Generally, such receivers have small solder pads to which electrical connections are made. Such solder connections are sometimes fragile and have been known to break. During manufacturing of hearing instruments with such receivers, great care must be observed so as not to damage the receiver or the solder connections.

It has further been recognized that the housings for shells used in conventional hearing instruments can become difficult and costly to manufacture. Their shapes are generally dictated primarily by the contours of the ear cavity in which they are intended to be positioned, but attempts to reduce the cost and difficulty of manufacturing conventional shells could reduce the available range of shapes and contours. Alternatively, the cost of manufacturing and the complexity of the manufacturing process remain substantial.

Accordingly, it is an object of the invention to provide a peritympanic hearing instrument that overcomes one or more of the disadvantages associated with conventional hearing instruments.

SUMMARY OF THE INVENTION

This invention provides a hearing instrument that is positionable in the external auditory canal of a human at a location that is proximal to the tympanic membrane. The preferred instrument includes a substantially rigid shell that is shaped to enclose a microphone as well as a receiver and that has a distal end portion that faces toward the tympanic membrane. The instrument also preferably includes a relatively flexible tip member that is connected adjacent to the distal end portion of the shell. The tip member includes a hollow body that defines a passage extending between its ends for the communication of acoustic signals through the tip member between the shell and the tympanic membrane. The hollow body of the tip member is sufficiently deformable to conform to the auditory canal. It is also sufficiently rigid to resist collapse of the passage upon insertion in the canal. An axis of the passage through the tip member is moveable at an angle with respect to the axis of the shell so that the hearing instrument can navigate the path of the external auditory canal upon insertion of the instrument toward the tympanic membrane and beyond the second bend of the canal. The tip member is positionable to seal against an inner surface of the canal.

According to an aspect of the invention, an embodiment of the hearing instruments also includes a joint positioned to provide a connection between the distal end portion of the shell and the tip member for rotation of the tip member passage's axis with respect to the shell's axis. This rotation is accomplished about a rotational axis that is structurally predefined by the joint.

It is also preferred for the shell to be shaped in such a way as to enclose the receiver's motor and diaphragm components. Such a shell eliminates any need for a separate receiver housing for enclosing the motor and diaphragm components, thereby reducing the cost of the receiver as well as the overall cost of the manufactured hearing instrument.

It is further preferred for the tip member of the hearing instrument to include the hollow body as well as protrusions such as flanges that are positioned adjacent to the body portion so as to extend radially outwardly. In such a preferred configuration, a perimeter portion of each of the protrusions is positionable against the inner surface of the external auditory canal to help center the tip member in the canal.

According to yet another preferred aspect of the invention, the shell of the hearing instrument includes multiple shell portions, each having an engagement surface that extends toward the shell's distal end. The shell portions are assembled along their respective engagement surfaces in order to enclose the microphone and receiver components of the instrument.

It is also preferred for the tip member to include a wax guard surface that is positioned adjacent to the distal end portion of the tip member's hollow body. The surface should traverse the diameter of the tip member's elongated passage in order to prevent undue ingress of cerumen from the external auditory canal into the elongated passage.

In order to prevent any substantial collapse of the elongated passage through the tip member upon insertion of the hearing instrument and bending of the tip member, the tip member preferably includes means positioned along a length of the hollow body and extending adjacent to the elongated passage for resisting such collapse. Such a structure permits elimination of the need for a bendable joint between the tip member and the remainder of the hearing instrument. An example of such means includes a spring that extends adjacent to the passage.

DESCRIPTION OF PREFERRED EMBODIMENTS

Figure 1:
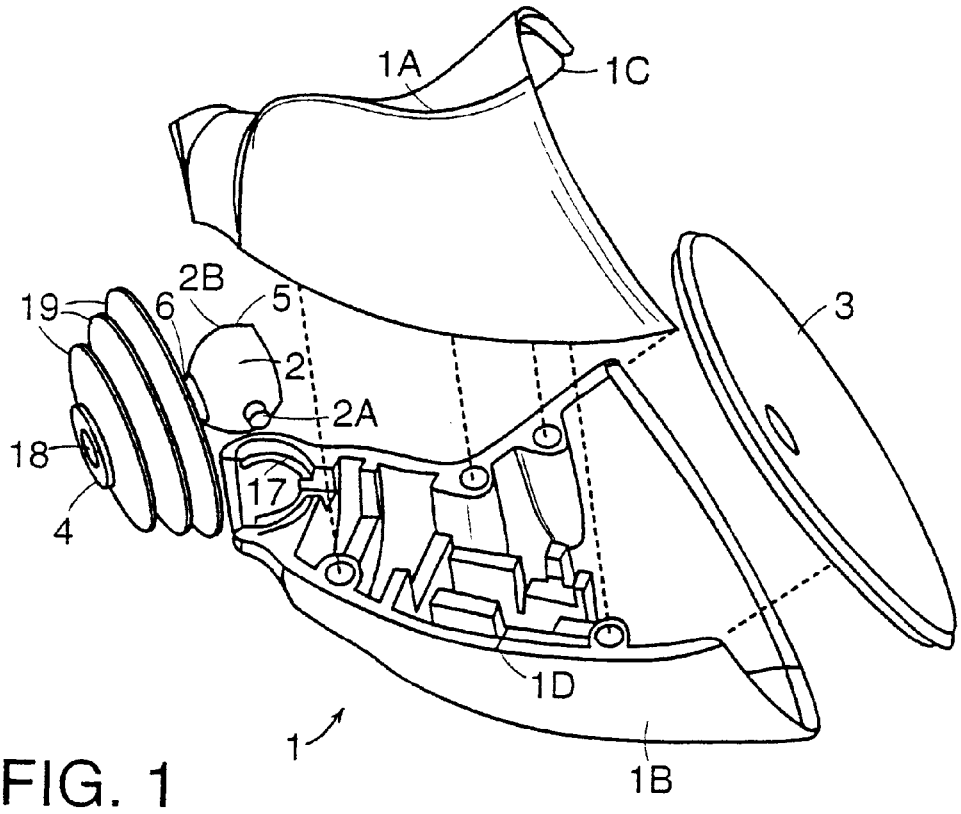
FIG. 1 is an exploded view of an embodiment of a hearing instrument having a two degree-of-freedom joint according to the invention.

The invention will now be described with reference to several embodiments selected for illustration. It will be appreciated that the invention is not limited to the specific embodiments shown in the drawings or described herein. Also, it will be appreciated that the drawings are not intended to be to scale or proportion. The following description is not intended to limit the scope or spirit of the invention, which is defined separately in the appended claims.

According to one of its aspects, the present invention surmounts the aforementioned limitations of conventional hearing instruments by providing a hearing instrument preferably having the equivalent of at least a single rotational degree of freedom near its tip. This instrument also can include a cerumen guard.

FIG. 1 illustrates an embodiment of the invention, namely a hearing instrument having a two degree-of-freedom (2-DOF) joint that allows the tip to extend into the perity-mpanic region of the ear canal. One advantage of this arrangement is that the 2-DOF mechanism facilitates the navigation of the typical centerline path of an ear canal. After insertion, the stationary location of the 2-DOF joint is preferred to be in the vicinity of the second (or distal) bend, i.e., between the second and third sections of the external auditory canal, as described above.

By placing the joint and tip so deeply into the ear, it also is possible to place the receiver closer to the eardrum to permit lower gain amplification to be used. The reduction in the level of amplification required by the instrument reduces the amount of power needed to drive the instrument amplifiers, which directly translates into a smaller battery and a smaller prosthesis.

Another advantage is that the 2-DOF jointed tip allows the generation of a seal near the bony region of the ear canal. An appropriate seal in this region can substantially mitigate the occlusion effect—whereby low frequency signals and noise are overly pronounced. The 2-DOF joint tip may be designed as a two-piece assembly such that a finned section of the tip member can be separated from the joint portion. A simple but effective retaining device such as a screw or snap can be used to effect assembly and permit disassembly. If a tip becomes unacceptably contaminated with wax, one could simply remove the old tip and subsequently screw or snap in a new one, rather than cleaning it.

Referring to FIG. 1, an instrument shell 1 is composed of an upper portion 1A and a lower portion 1B. It is shown in an exploded view for clarity. When assembled, the shell is designed to fit comfortably within the ear canal. Construction of instrument shell 1 from multiple shell portions such as upper portion 1A and lower portion 1B has been discovered to be beneficial from both the standpoint of cost reduction and ease of manufacturing. The first bend of the external auditory canal is generally a severe bend, as described earlier. Referring specifically to FIG. 1, the shell 1 is shaped to conform to this first bend so that it can fit comfortably within the user's ear canal. It is of course, preferred that the primary consideration in determining the exact shape of the shell should be the user's comfort when wearing the hearing instrument and that cost and manufacturing ease should be secondary considerations.

Conventional hearing instruments generally include cup-shaped shell components, such as those suggested in Voroba U.S. Pat. No. 4,870,688, and in Shennib U.S. Pat. No. 5,701,348. Nevertheless, it has been discovered that the use of injection molding processes to form a cup-shaped shell can be inadequate. A standard injection mold cannot be easily adapted to form the ideal contours of a comfortable shell because the resulting shell would be difficult to extract from the mold due to the first bend contours. Also, it would be difficult to extract the center core of the mold; especially if a large multicavity mold is used. Alternatively, a complicated and expensive injection mold structure would have to be employed in order to form the complex contours of the shell's outer surface.

It has been discovered that, instead of the use of a cup-shaped shell component, the use of a so-called "clam" shell configuration such as the one illustrated in FIG. 1 has many benefits. It can be more easily formed using conventional injection molding processes because each of the shell portions or clam-shell halves can be easily extracted from the mold tooling. At the same time, such shell components can be easily provided with alignment bosses and alignment recesses so that the shell portions can be assembled with ease and with accuracy to form the shell. Accordingly, the primary consideration for the selection of the contours of the shell can be the comfort of the user while using a simple injection molding and assembly process and while maintaining a low manufacturing cost.

As shown in FIG. 1, the shell portions 1A and 1B are most preferably provided with engagement surfaces 1C and 1D, respectively, that extend from the proximal portion of the shell 1 (the larger diameter portion) to the distal end portion of the shell. It is noted that these surfaces can include alignment features such as tongue-and-groove joints, etc. The shell portions, 1A and 1B are substantially mirror images of one another and each of the shell portions 1A and 1B represents approximately one half of the shell. It is also apparent in FIG. 1 that each of the shell portions 1A and 1B include internal contours and surfaces that permit the formation of internal compartments when the portions are assembled. It is these internal compartments that house the various components of the hearing instrument, including the instrument's receiver, microphone, electrical circuit, and other conventional hearing instrument components. The clam-type shell and internal compartments allow the optional use of total automation using simple pick and place equipment.

Referring still to FIG. 1, a portion of the 2-DOF joint 5, which is in the form of a ball and socket joint in this particular embodiment, can be formed at one end of the shell 1, obtaining the 2-DOF as follows: (1) rotation about the predefined axis of the detents or pin-bosses 2A and 2B on the ball 2 is allowed; and (2) predefined rotation in the plane of the slot 17 at the tip of the shell 1 is also permitted.

More specifically, still referring to FIG. 1, the joint 5 is formed by engagement by ball 2 in a cavity defined by the assembly of shell portions 1A and 1B to form shell 1. It will be understood that the cavity formed by shell 1 snugly accommodates ball 2 while permitting rotation. Such engagement most preferably prevents unintended separation of ball 2 from the socket in shell 1, yet may preferably be adapted for intended disengagement of ball 2 from shell 1, if desired, so that the tip member can be removed and replaced by the user of the hearing instrument.

In this embodiment, radially outwardly extending detents 2A and 2B on ball 2 share a common, predefined axis and are preferably diametrically opposed from one another on opposite sides of ball 2. These detents 2A and 2B together define a rotational axis about which ball 2 can rotate with respect to shell 1. Such a rotational axis predefines one DOF so that a tip member 4 of the hearing instrument can be rotated about that predefined axis.

To provide a second DOF for joint 5, a slot 17 is defined by the assembly of shell portions 1A and 1B of shell 1. Slot 17 is sized and positioned to capture detents 2A and 2B of ball 2 in such a way that detents 2A and 2B can travel within the slot 17 in the general plane of slot 17. Accordingly, slot 17 cooperates with detents 2A and 2B to provide a second predefined axis of rotation between ball 2 and shell 1. The actual rotational axis provided by the interaction of detents 2A and 2B with slot 17 is substantially perpendicular to the plane in which the slot 17 resides.

A connection 6 is provided between ball 2 of ball joint 5 and the body portion of tip member 4 as will be described later. Tip member 4 has a substantially hollow body that defines a passage 18 extending between its ends. Although not shown in FIG. 1, passage 18 extends throughout the length of tip member 4 and along its axis and even extends outwardly to the rear or proximal end of ball 2 in this embodiment. In this manner, passage 18 acts a conduit for communication of acoustic signals between the body of the hearing instrument and the tympanic membrane. Passage 18 is preferably elongated, having a length that is larger than its diameter.

Tip member 4 also includes in this embodiment a plurality of circumferential fins 19 that are connected to the hollow body portion of tip member 4 and extend radially outwardly from the hollow body. Protrusions such as fins 19 are not required but, if desired, fins 19 can be formed integrally with the remainder of tip member 4 such as by a molding operation although separate assembled components are contemplated as well. Further details of optional fins 19 on tip member 4 will be provided later.

Various nests, compartments, and other alignments can be seen in the shell illustrated in FIG. 1. These nests accommodate the hearing instrument's receiver, microphone, and electronics, while the alignment bosses and mating sockets on the shell portions 1A and 1B insure proper alignment of the shell halves. Outer or proximal face plate 3 and tip member 4 of the hearing instrument act in concert with portions 1A, 1B to enclose and protect the electroacoustically active components of the instrument (not shown).

Tip member 4 in this embodiment is constructed such that it contains an integral ball 2 with pin-type bosses 2A and 2B. These bosses mate with the appropriate slot 17 in the shell halves to form the 2-DOF joint. Highly-compliant and biocompatible fins 19 are preferred on tip member 4 in order to provide an effective seal in the ear canal. Because the tip fin 19, or rings, are preferably thin and constructed of a low modulus, low durometer material, the tip member 4 will provide a high level of comfort for the user even when it is inserted into the bony region of the ear.

It is preferred for the modulus of elasticity for the tip rings 19 to be less than about 500 psi. A modulus of elasticity of less than about 50 psi is most preferred, thus permitting greater comfort to the user yet affording sufficient thickness to the rings to facilitate manufacturing of the tips. The resulting thickness of the fins 19 is preferably on the order of about 20 mils, although other thicknesses and materials are contemplated as well.

It also is preferred that the shell 1 of the instrument be composed of a substantially biologically inert, generally rigid substance with a low coefficient of friction and which is amenable to mass-production techniques, such as, for example, NORYL™, manufactured by GE. Other materials are contemplated as well. The shell 1 can be partially or completely enshrouded by a layer of complaint, biocompatible material (not shown) to increase the comfort experienced by the user and to help protect the articulated portions of the instrument.

Figure 2:
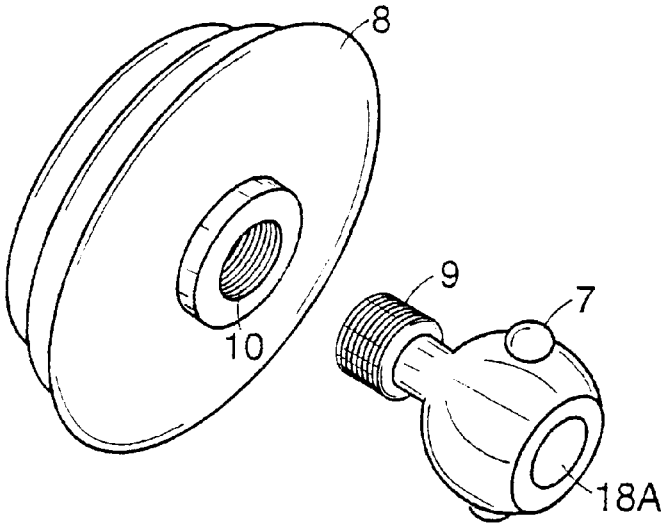
FIG. 2 is an exploded view of an embodiment of a removable fin section and joint portion for the hearing instrument shown in FIG. 1.

FIG. 2 illustrates a 2-DOF joint designed to allow the finned tip member to be easily replaced by a user, if desired. The tip assembly includes a joint member 7 and a finned tip member 8 which may be releasably fastened using a connector such as screw 9 and threaded socket 10. Other releasable fasteners, such as a snap connector and other known fastening systems, also may be used. Such an assembly is especially beneficial when the joint member 7 is permanently engaged in the shell's socket. Joint member 7 is preferably formed from a relatively rigid material as compared to tip portion 8. The extension of passage 18 (FIG. 1) through the ball of joint member 7 is indicated by "18A."

Figure 3:
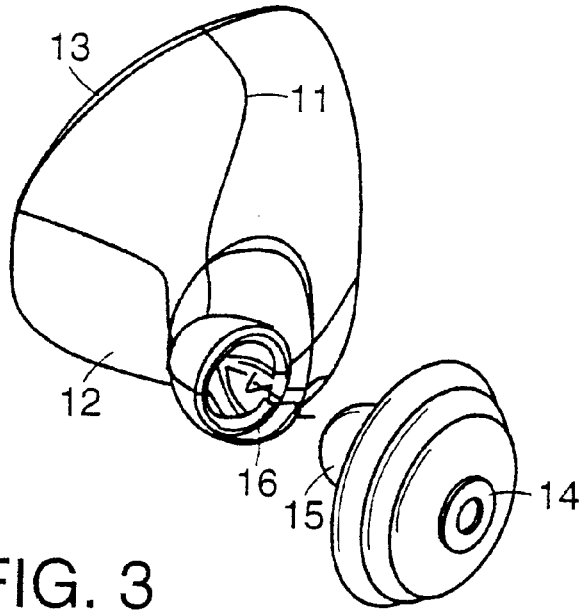
FIG. 3 is an exploded view of an embodiment of a hearing instrument having a three degree-of-freedom joint.

FIG. 3 illustrates another embodiment of the present invention, having a three-degree of freedom ball-and-socket joint. Here, socket portion 16 of the 3-DOF joint is formed at one end of a shell having shell portions 11, 12. Similar to the structure illustrated in FIG. 1, the device in FIG. 3 can include an outer face plate 13 and a tip member 14. Tip member 14 is preferred to be constructed such that it contains an integral ball 15 as well as complaint, biocompatible fins that provide an effective seal in the external auditory canal proximal to the tympanic membrane.

The socket portion 16 of the 3-DOF joint engages the integral ball 15 in such a way as to permit free rotation of the ball within the socket about three axes of rotation. Such predetermined rotational axes provides a wide range of adjustments to conform to the specific contours of an individual's external auditory canal. Although such unlimited freedom of rotation may be preferred in some circumstances, it has been discovered that the joint illustrated in FIG. 1 having two predetermined axes of rotation or a joint having only one predetermined axis of rotation (to be described later with reference to FIG. 4) are very beneficial. Although the exact configuration of users' canals cannot be anticipated precisely, results of surveys of measurements can predict the general contours of normal ear canals. Accordingly, predefined axes of rotation (or a single predefined axis), if oriented to accommodate normal ear canals, can bring about an improved hearing instrument configuration as it is installed in a normal canal. Unlimited articulation of the tip component on the other hand can perhaps inhibit proper installation in some circumstances because there is little control over the movement of the tip with respect to the remainder of the instrument.

Figure 4:
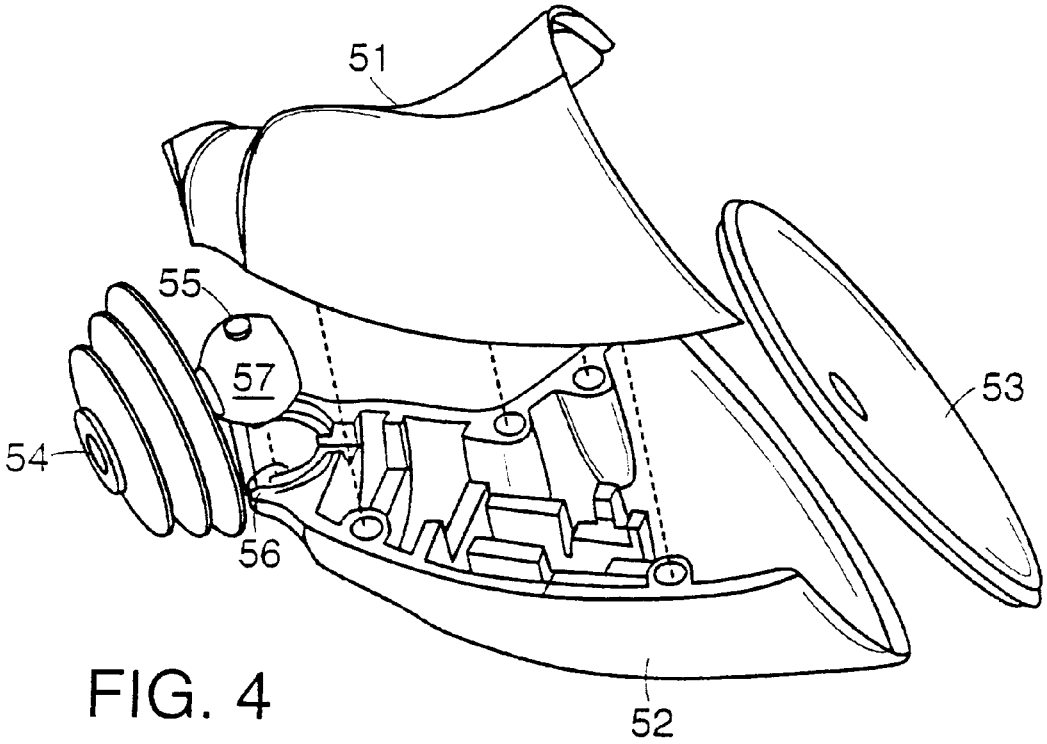
FIG. 4 is an exploded view of an embodiment of a hearing instrument having a one degree-of-freedom joint.

A hearing instrument incorporating a single-degree of freedom (DOF) revolute joint is shown in FIG. 4. In the device illustrated in FIG. 4, a portion of the 1-DOF joint can be formed at one end of the shell, which in this embodiment includes shell portions 51 and 52. Various nests and other alignment features can be used to accommodate the hearing instrument's receiver, microphone, and electronics, while the alignment bosses and mating sockets insure proper alignment of the shell halves 51 and 52. Upper subshell 51 and lower subshell 52 can, as with previous embodiments, work in concert with other structure parts, such as face plate 53 and tip member 54, to envelop and protect the electroacoustical components therein (not shown).

It is preferred that tip 54 be constructed so that it includes an integral ball 57 with pin-type detents or bosses 55 (one shown) which mate with the appropriate recesses, such as recess 56, formed in the shell halves 51 and 52. This assembly forms the revolute joint with a single predetermined axis of rotation. It also is preferred that complaint fins be provided on tip member 54 to provide an effective seal in the ear canal. It should be mentioned that the fins are preferably thin and constructed of a low modulus, low durometer material, similar to the embodiments described above.

Figure 5:
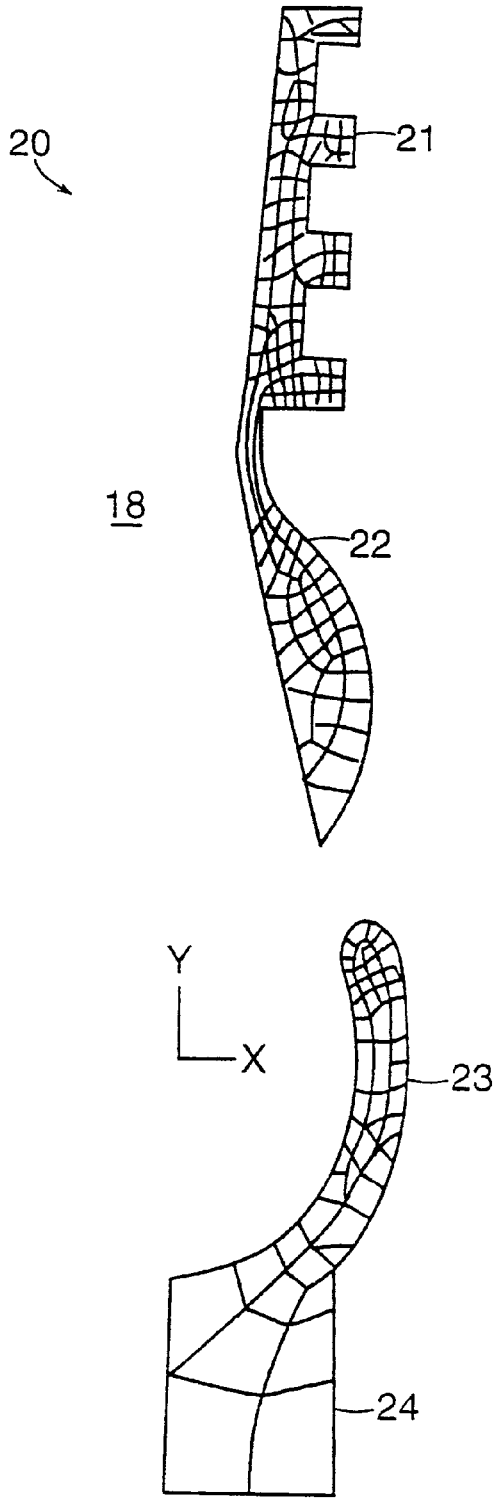
FIG. 5 is a graphical finite element analysis representation of an embodiment of a ball and socket joint before partial assembly.
Figure 6:
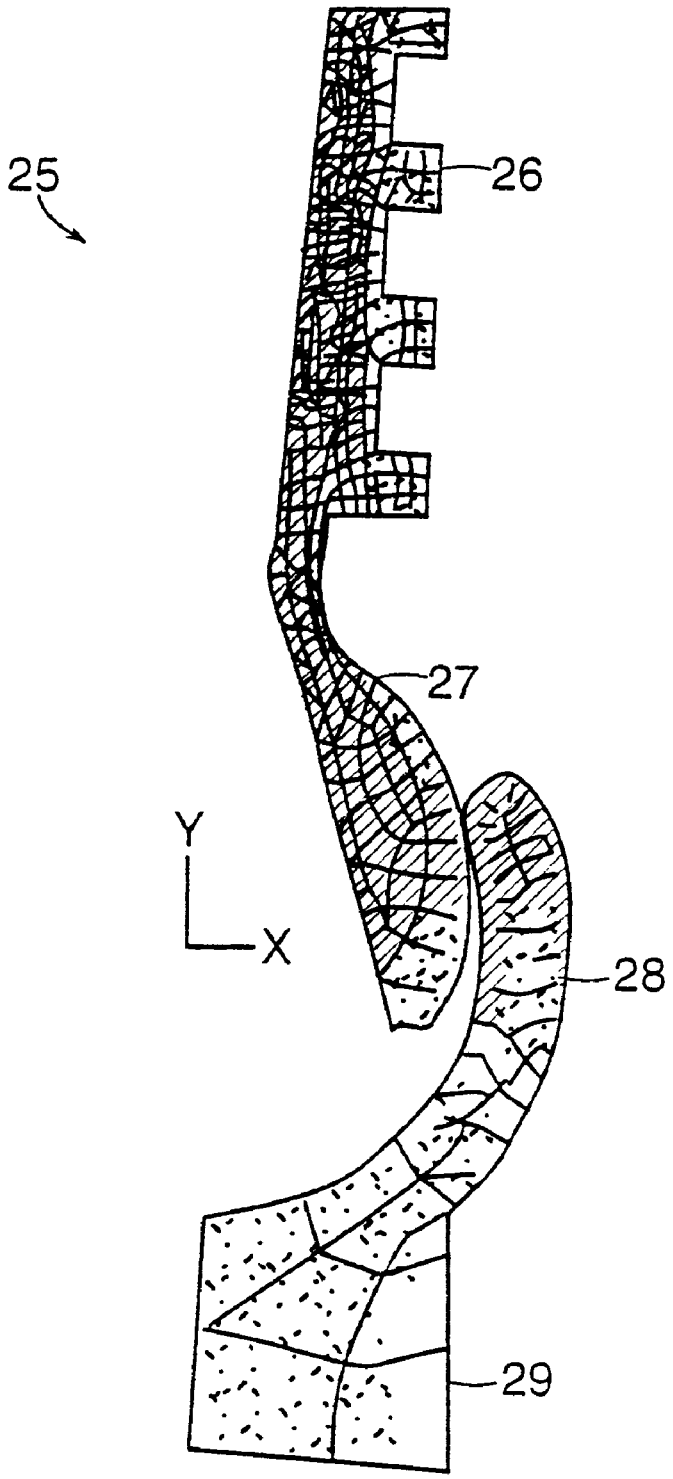
FIG. 6 is a graphical finite element analysis representation of an embodiment of a ball and socket joint after partial assembly.
Figure 7:
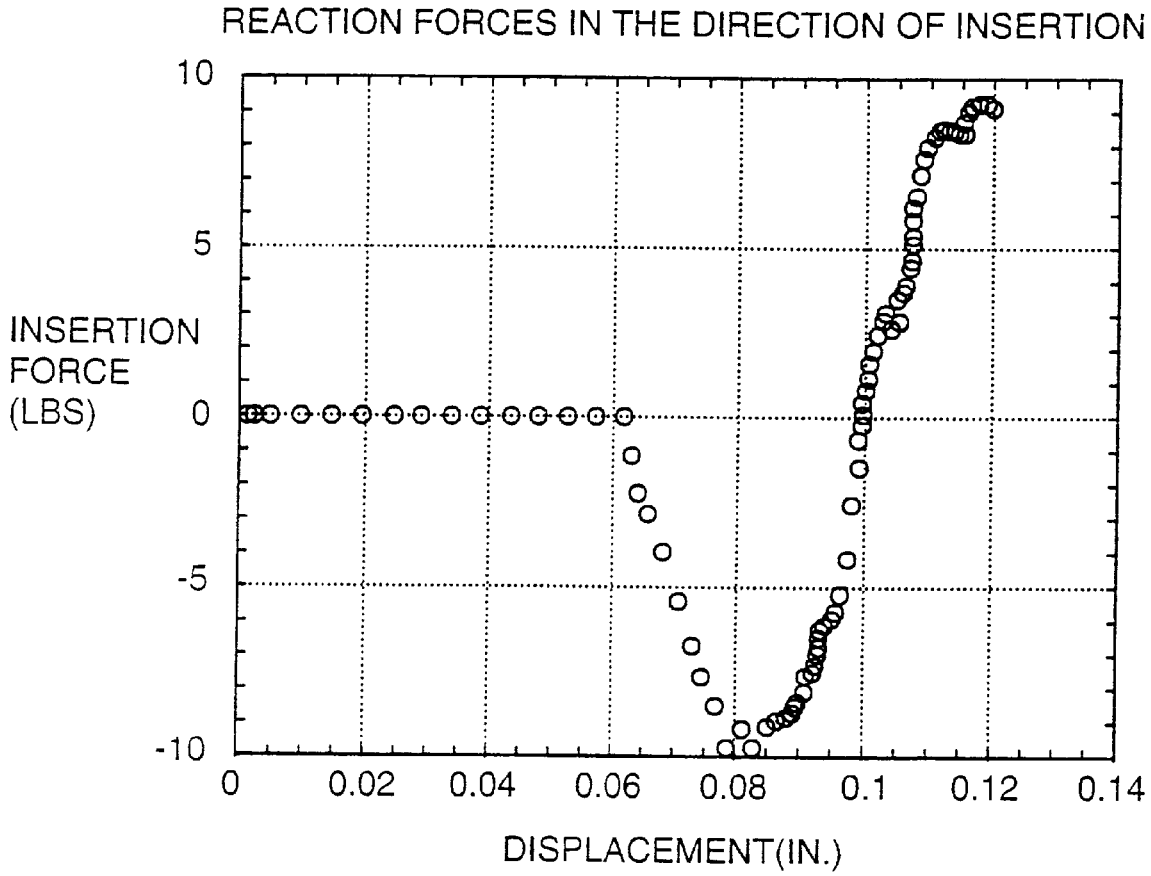
FIG. 7 is a graphical plot of the forces associated with an embodiment of a ball and socket joint during partial assembly.

The ball joint of any of the presented embodiments preferably can be designed so that it could be engaged and disengaged by the user when desired. Alternatively, the joint components could be dimensioned so that it would be extremely difficult to disengage the joint without destroying the socket and/or ball. FIGS. 5, 6, and 7 illustrate exemplary forces that can result from assembly of the joint. The physical characteristics of the shell can be modified to suit the desired goal.

FIG. 5 illustrates a ball and socket joint before insertion of the ball into the socket. The ball and socket joint is generally designated by the numeral "20". It includes a socket supported by a tubular portion 24 from which a socket cup 23 extends. The ball 22 is shown to be integrally formed as part of a tip member having a series of fins or rings 21, as well as a central passage 18. As shown in FIG. 6, a ball 27 is partially inserted into a socket cup 28 that is connected to a tubular portion 29. This ball and socket joint is generally designated by the numeral "25", and the tip portion illustrated also includes a series of fins 26. As illustrated in FIG. 6, insertion of ball 27 into the cup-shaped socket 28 causes deformation of the cup as well as the generation of stresses in the respective components. FIG. 7 illustrates ball and socket joint insertion forces that are generated upon insertion of the ball into the socket.

Figure 8:
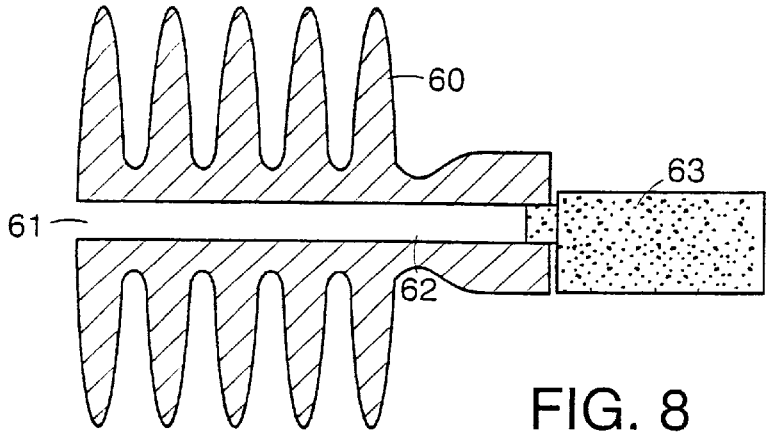
FIG. 8 is a cross-sectional side view of an embodiment of an ear tip without a cerumen guard.
Figure 9:
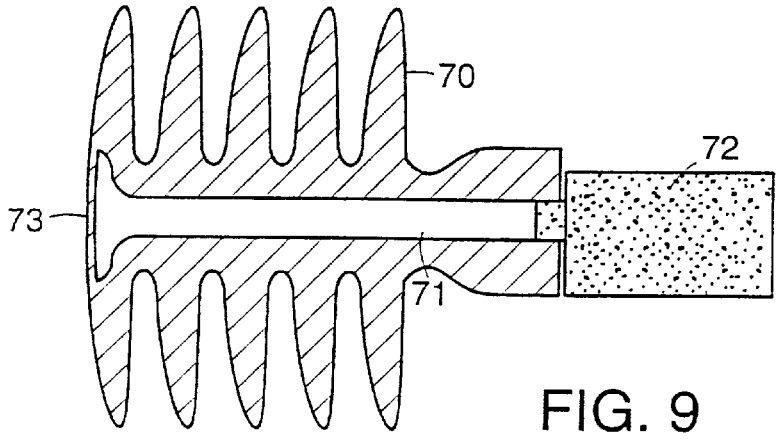
FIG. 9 is a cross-sectional side view of an embodiment of an ear tip with a cerumen guard.
Figure 10:
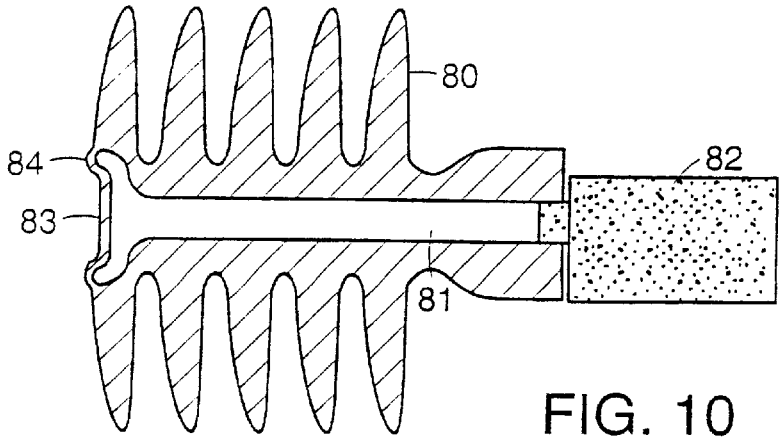
FIG. 10 is a cross-sectional side view of an embodiment of an ear tip with another embodiment of a cerumen guard.

As noted earlier, ear wax can partially or completely occlude the tip member of the device at a location proximal to the tympanic membrane, thereby leading to a sharp reduction in the user's perceived sound quality. FIGS. 8–10 illustrate a preferred feature of the invention that is adapted to avoid the detrimental effects of occlusion of the tip member. The ear tip members 60, 70, and 80 (FIGS. 8–10, respectively) each include multiple, thin, compliant fins, which form a seal in the ear canal. The tip embodiments illustrated in FIGS. 8–10 differ from those previously described in that they are not connected to the remainder of the hearing instrument by a joint; instead, they conform to the ear canal by deformation along their length as will be described later.

In FIG. 8, ear tip member 60 lacks a cerumen guard to prevent cerumen ingress, thereby exposing an end opening 61 to encroachment by wax which can result in the sound port or sound tube 62 becoming at least partially occluded. This is the passage through which acoustic signals are communicated. Such occlusion can lead to the distortion and attenuation of the sound transmitted from the receiver 63 to the tympanic membrane through sound port 62. Nevertheless, tip member 60 can be adapted so that it can be intentionally removed from the remainder of the hearing instrument. Accordingly, it can be replaced periodically to eliminate the cerumen build up.

As an alternative solution to this problem, cerumen "guards" have been discovered as will be disclosed. As seen in FIGS. 9 and 10, it is preferred that the guards comprise a thin, flexible membrane positioned at the distal end portion of the tip member in order to keep cerumen from entering the sound port, yet while remaining substantially acoustically transparent. Whether or not acoustically transparent, the guards should be capable of transmitting acoustic signals between the ear canal and the tip's passage.

FIG. 9 shows an ear tip member 70 that is substantially similar to tip member 60, but with a wax guard membrane 73. Membrane 73 may be molded at the same time as ear tip 70 so as not to add any significant cost to the item. Alternatively, it can be assembled onto an end surface of the tip. The membrane may be of any thickness, but the membrane is preferably in the range from about 0.5 to about 1.5 mils thick and the membrane most preferably is about 1.0 mils thick. Membrane 73 should preferably be thin enough to let most of the acoustical energy pass through. It is preferably made of a low-modulus, tear resistant and durable material, such a C-FLEX™ available from Consolidated Polymer Technologies, Inc. Other materials can be used; preferably, Liquid Injection Moldable (LIM) materials such as silicone. A Shore A durometer less than about 5 is also preferred. If cerumen collects on the membrane 73, the user may easily clean the surface, with a simple wiping action, for example. Membrane 73 will substantially prevent cerumen from entering and blocking sound channel 71. Accordingly, passage or sound port 71 remains substantially free from obstruction to permit the communication of acoustic signals from the receiver 72 from which it extends.

FIG. 10 illustrates an alternate membrane configuration for the wax guard. A complaint surround portion 84 attaches the central portion of the wax guard 83 to the rest of the ear tip member 80. Complaint surround 84 allows membrane 83 to vibrate more freely as compared to the configuration shown in FIG. 9, thereby permitting more acoustical energy to pass from the receiver to the tympanic membrane of the ear.

In the configurations of FIGS. 9 and 10, it has been discovered that the wax guard membranes 73 and 83 beneficially act as an acoustical filter. By adjusting the thickness or material properties of the membranes 73, 83, they may be tuned to alter or improve the subjective sound quality of the hearing aid. These properties can be manipulated to dampen the mechanical and acoustical resonances of the receiver, sound channel, and ear canal; thus providing a smoother frequency response. The membranes are most preferably adapted to minimize or eliminate attenuation of the acoustic signals.

Although the exact configuration of the shell (such as item 1 in FIG. 1) is not critical to the invention, it has been discovered that preferred embodiments of the shell can significantly reduce the cost of manufacturing a hearing instrument according to this invention.

Of all the components in a hearing aid, the microphone and receiver (loudspeaker) are perhaps the most costly. Of these two, the receiver is often the more costly item. Knowles Electronics, Inc., of Itasca, Ill. (USA), and Microtronics, of Amsterdam, The Netherlands, produce a variety of microphones and receivers that are currently used in hearing aids. The typical cost of these components is as much as about $25 or more for the pair (microphone and receiver). To lower the cost of manufacturing hearing aids significantly, the cost of the microphone and receiver components should be reduced. It is the goal of another aspect of this invention to lower this cost by integrating the receiver into the hearing instrument housing.

Conventional receivers can be described as self-contained receivers that are traditionally mounted in a metal receiver housing. In general, conventional receiver housings have small solder pads to which small wires are soldered to make electrical connection to the receiver. The soldered connections are often fragile and can easily break. In manufacturing a conventional hearing aid, great care must be observed so as not to damage the receiver or soldered connections.

According to a preferred aspect of this invention, the internal components of the receiver are integrated with the housing, or shell, of the hearing instrument. The conventional metal housing of the receiver is not used; rather, the shell of the hearing instrument also serves as the housing for the receiver components in order to provide a lower cost hearing aid system and to provide more room for the receiver because the conventional metal housing of the receiver is no longer needed. Such construction also permits the use of larger, more robust wires with which electrical connections to the receiver can be made. With more room available for the receiver components, larger and lower cost components can be used.

In one embodiment, referring back to FIG. 1, the motor assembly (not shown) of the receiver is mounted in the lower shell portion 1B of the shell 1. The diaphragm (not shown) for the receiver is mounted in the upper shell portion of 1A of shell 1. A drive pin (not shown) extends from the motor assembly. A drop of adhesive (e.g., epoxy) is applied to the drive pin, and the two shell portions 1A and 1B are brought together. The shells are sealed either by solvent sealing, adhesives, ultrasonic welding, or other known methods. Wire leads pass through holes (or slots) in the lower shell portion 1B of shell 1, and are used to make electrical connection to the receiver. These wires may be bent into a position so that a flex-circuit assembly, containing the hearing aid electronic circuitry, can easily be secured to the wires. The motor assembly is preferably secured in place using an adhesive, such as epoxy, or a snap connection. The diaphragm is preferably secured to the upper shell portion 1A of shell 1 with an adhesive, by solvent sealing or by other known methods.

Figure 16:
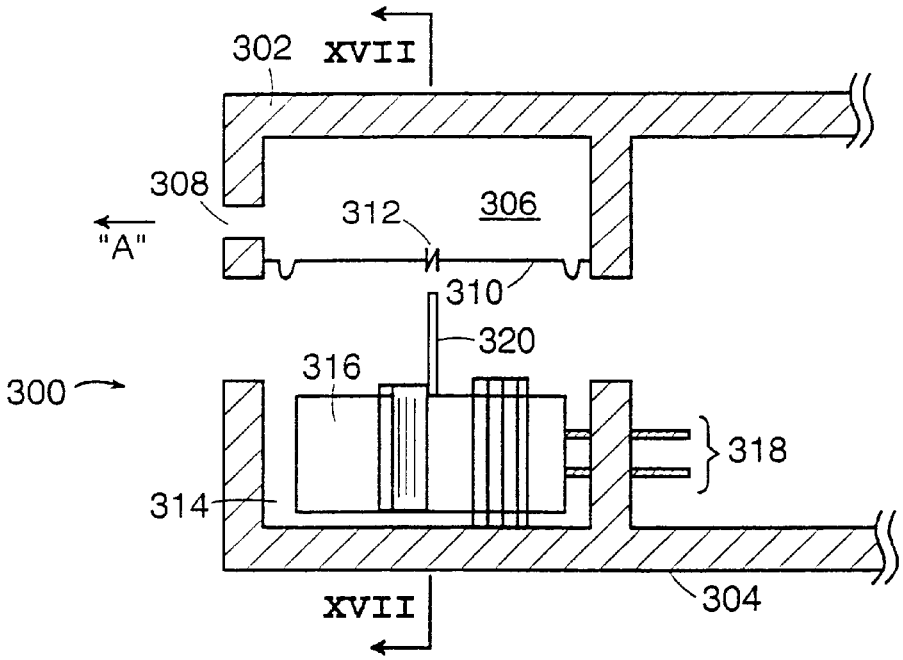
FIG. 16 is an exploded, cross-sectional side view of a portion of an embodiment of a hearing instrument shell according to this invention.
Figure 17:
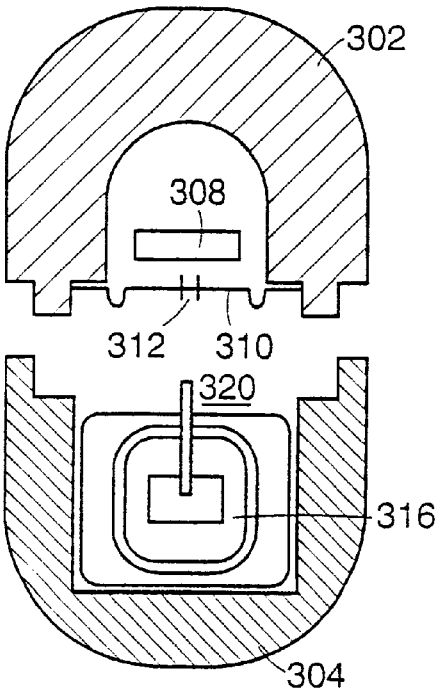
FIG. 17 is an exploded, cross-sectional end view of the hearing instrument shell shown in FIG. 16.

Referring now to FIGS. 16 and 17, an embodiment of a hearing instrument 300 is illustrated in which a balanced armature-type receiver is utilized. Hearing instrument 300 includes an upper shell portion 302 and a lower shell portion 304. The upper shell portion 302 is configured in such a way as to form a sound chamber 306. An outlet sound port 308 permits the transmission of output sound "A" outwardly from sound chamber 306. A diaphragm 310 is mounted to upper shell portion 302 adjacent to (and at least partially enclosing) sound chamber 306. Diaphragm 310 is mounted to upper shell portion 302 by means of adhesive or other equivalent bonding or mechanical means. Diaphragm 310 includes a drive pinhole 312 which is provided to accommodate the drive pin of a motor assembly, as will be described later.

Lower shell portion 304 is provided with contours that define a compartment 314 which is positioned and sized to accommodate a motor assembly 316. Electrical connections 318 are provided for connection between motor assembly 316 and other hearing instrument components (not shown). Drive pin 320 extends upwardly from motor assembly 316. It is positioned so that it will extend through drive pinhole 312 in diaphragm 310 when upper and lower shell portions 302 and 304 are brought together during assembly. FIG. 17 provides a cross-sectional end view substantially along the axis of hearing instrument 300 to further illustrate features of this embodiment.

Positioning of the motor assembly and the diaphragm is highly beneficial in this embodiment to assure that the drive pin of the motor assembly is aligned with a small hole in the diaphragm. This is especially true when the motor assembly is part of a balanced armature-type receiver. For example, a moving armature transducer generally includes a non-movable coil on a magnetic structure. A moving armature completes the magnetic path. As current in the coil varies, the force on the armature varies and the armature moves. The armature may be attached to a separate diaphragm, or it may be the diaphragm itself. Moving armature transducers may be of the balanced-armature or unbalanced armature types. In general, the balanced-armature type has lower distortion than unbalanced-armature types. However, the balanced-armature structure may require two matched magnets as compared to the unbalanced-armature construction which uses only one magnet.

When the two half shell portions 1A and 1B are brought together, visual alignment cannot be used because the drive pin of the motor assembly and diaphragm are hidden by the shell portions. The diaphragm and upper shell portion 1A form a sound chamber in which an output sound port is located. Electrical current passing through the voice coil of the motor assembly causes the drive pin to vibrate, which in turn vibrates the diaphragm. The sound pressure created in the sound chamber escapes through the output sound port. A very small hole (not shown) in either the diaphragm or the lower shell portion 1B provides means for atmospheric pressure equalization.

In another embodiment, also comprising a balanced armature-type receiver, the diaphragm is also mounted in the lower shell portion 1B together with the motor assembly. After the motor assembly is mounted in the lower shell portion 1B, the diaphragm is mounted in the lower shell portion 1B with the drive pin of the motor assembly extending through a small hole in the diaphragm. A small drop of adhesive, such as epoxy, is then applied to the drive pin to secure it to the diaphragm. Unlike the previous embodiment, alignment of the diaphragm and the motor assembly's drive pin can be made by visual means. Also, machine (automated) assembly is made easy because alignment of all of the receiver components can be referenced to a single half shell portion (in this case, shell portion 1B). Accordingly, alignment of the upper and lower shell portions 1A and 1B is not as critical as it is with the previous embodiment.

Figure 18:
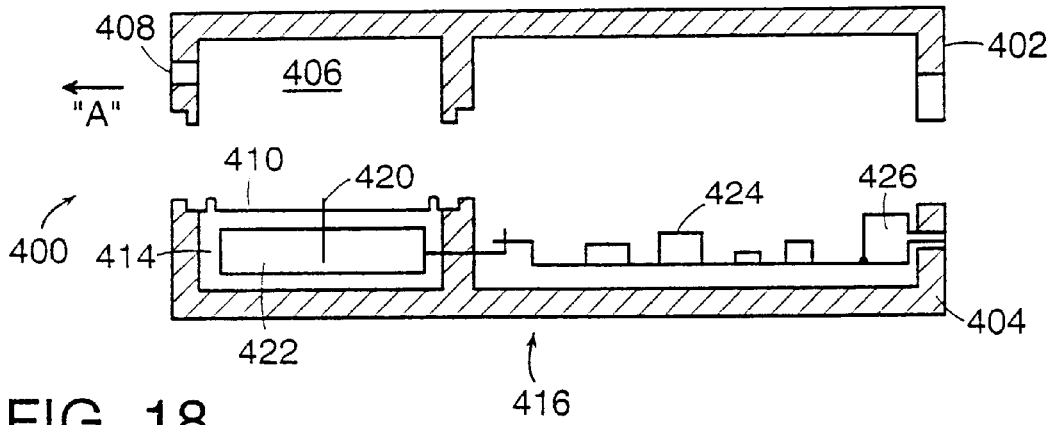
FIG. 18 is an exploded, cross-sectional side view of a portion of another embodiment of a hearing instrument shell according to this invention.

FIG. 18 provides a cross-sectional side view of an embodiment of a hearing instrument 400 that includes a balanced armature-type receiver wherein the diaphragm is also mounted in the lower shell. Hearing instrument 400 includes an upper shell portion 402 and a lower shell portion 404. A sound chamber 406 is provided in the upper shell portion 402 and an outlet sound port 408 is provided for the communication of output sound "A". Lower shell portion 404 is provided with a surface to which diaphragm 410 is mounted. Lower shell portion 404 accommodates a motor assembly 416. Specifically, a compartment 414 accommodates a receiver motor 422 and an adjacent compartment accommodates various electronic components 424, including a microphone 426. In this FIG. 18, a drive pin 420 connected to receiver motor 422 is shown to be extending through a hole in diaphragm 410.

The previously described embodiments of the invention relating to the receiver housing include a typical balanced armature-type receiver such as those manufactured by Knowles Electronics and Microtronics in which a drive pin is used to transfer the vibrations of the armature to the diaphragm. In yet another embodiment, the balanced armature-type receiver is replaced by an electrodynamic loudspeaker in which the voice coil is mounted directly to the diaphragm. Such an electro-dynamic loudspeaker (or moving coil transducer) generally includes a coil attached directly to a diaphragm. The coil is positioned within a magnetic field. Current passing through the coil creates a force that moves the coil and hence the diaphragm. Such electrodynamic loudspeakers are available from many sources and are also known as moving coil loudspeakers. A permanent magnet assembly, which provides the needed magnetic field, is preferably mounted in the lower shell portion 1B. The thin, flexible wires of the voice coil are connected to wire leads that provide the means to connect the loudspeaker to the hearing aid electronic circuitry.

Figure 19:
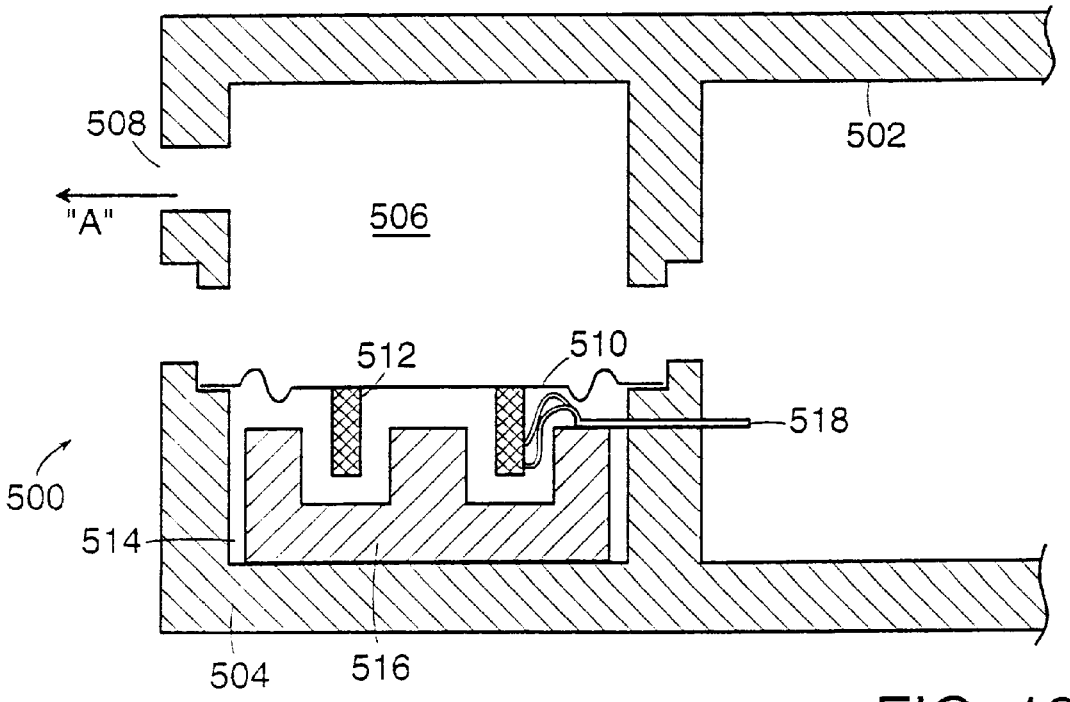
FIG. 19 is an exploded, cross-sectional side view of a portion of yet another embodiment of a hearing instrument shell according to this invention.

An embodiment of a hearing instrument 500 including an electrodynamic loudspeaker is illustrated in FIG. 19. As with the previous embodiments, an upper shell portion 502 is configured to define a sound chamber 506 as well as an output sound port 508 for outward communication of output sound "A." A diaphragm 510 is mounted to the lower shell portion 504 and a voice coil 512 is mounted to a surface of diaphragm 510. Positioned within a compartment 514 in lower shell portion 504 is a permanent magnet assembly 516. The voice coil 512 is connected to other hearing instrument components (not shown) by means of electrical connections 518.

As mentioned previously, a moving armature type loudspeaker can also be used. The advantage of the moving armature type loudspeaker over the electrodynamic loudspeaker is that the voice coil does not vibrate with the diaphragm. This allows more turns to be used in the voice coil to permit operation at lower currents. For hearing aid applications, low current, and hence low power, is highly desirable.

Figure 20:
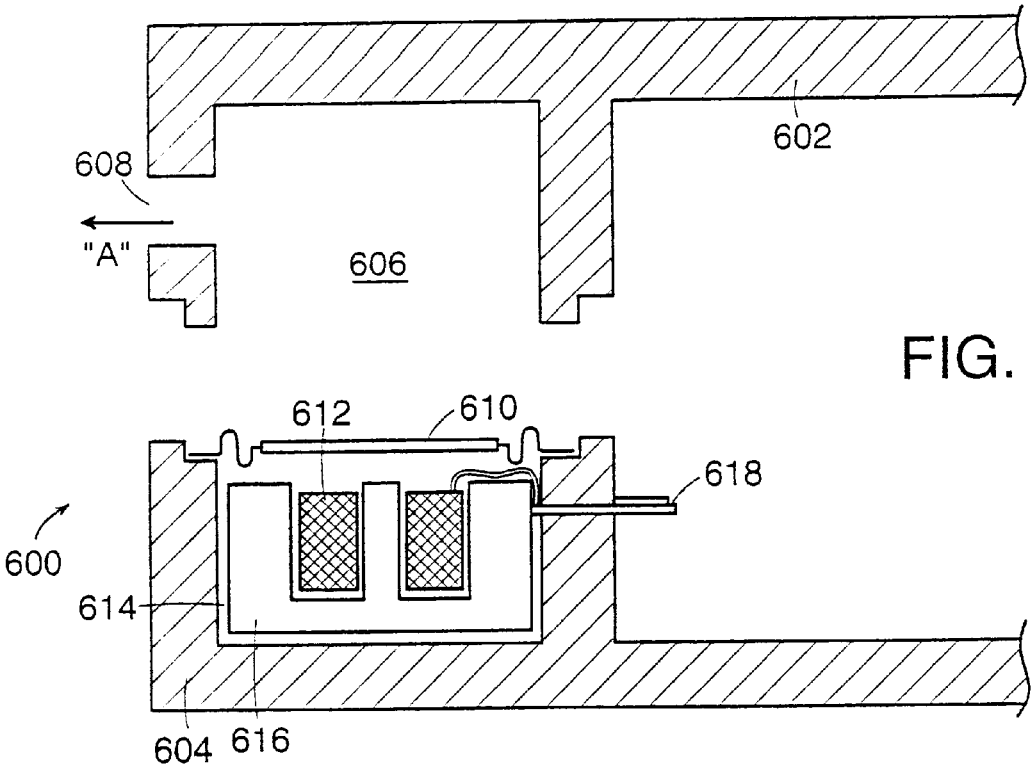
FIG. 20 is an exploded, cross-sectional side view of a portion of still another embodiment of a hearing instrument shell according to this invention.

FIG. 20 illustrates a cross-sectional side view of another embodiment of a hearing instrument 600 which includes an unbalanced moving armature type loudspeaker. Upper shell portion 602 defines a sound chamber 606 adjacent to an output sound port 608 for output sound "A." Lower shell portion 604 provides a mounting surface for diaphragm 610 which is a magnetic diaphragm adapted for unbalanced moving armature type loudspeakers. Lower shell portion 604 provides a compartment 614 that is sized and shaped to accommodate a magnet assembly 616 within which is positioned a voice coil assembly 612. Voice coil assembly 612 is connected electrically to other hearing instrument components (not shown) via electrical connections 618.

An electret loudspeaker (electrostatic loudspeaker) can also be used. The electret loudspeaker is simple in construction and does not contain a voice coil. The voice coils needed in the other loudspeakers use fine gauge wires and may be fragile. The electret loudspeaker uses a construction similar to low cost electret microphones. In general, electrostatic transducers include two parallel plates, one of which is a thin flexible membrane. A charge is imposed on the plates either by applying a dc voltage, or by inserting charge into a dielectric (electret transducer). The electrostatic forces between the two parallel plates cause the plates to move towards each other. By superimposing an ac voltage, the electrostatic forces will vary and the diaphragm will move.

Figure 21:
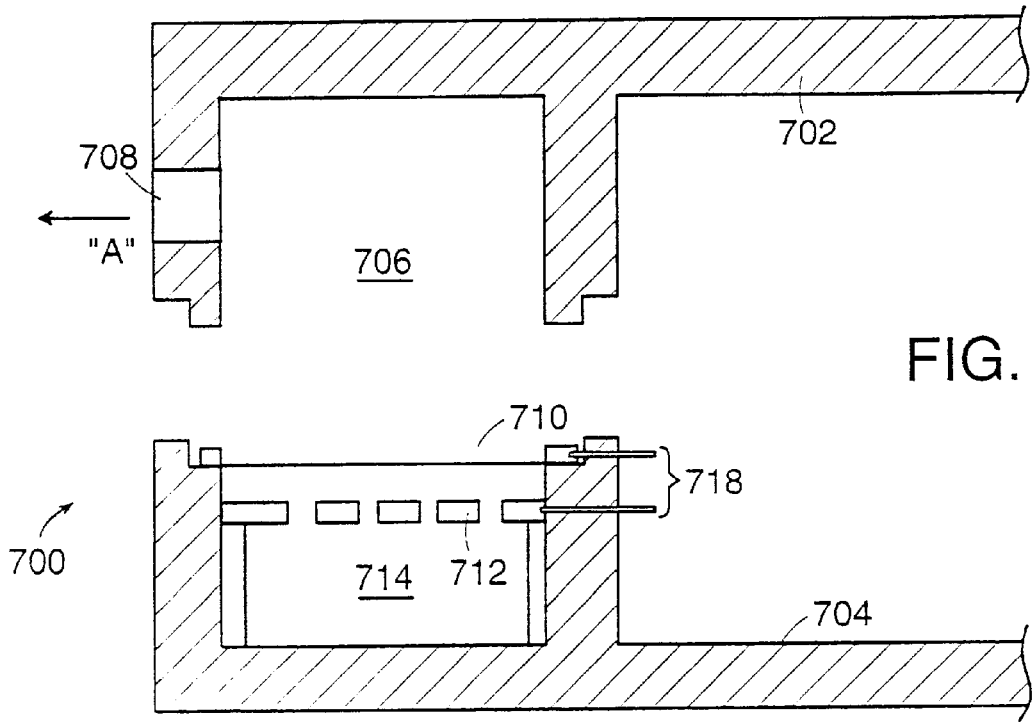
FIG. 21 is an exploded, cross-sectional side view of a portion of another embodiment of a hearing instrument shell according to this invention.

Referring now to FIG. 21, yet another hearing instrument 700 is illustrated. This embodiment is shown with an electret loudspeaker. Upper shell portion 702 defines a sound chamber 706 that communicates output sound "A" through an outlet sound port 708. An electret diaphragm 710 is mounted to lower shell portion 704 adjacent to and above a back electrode 712 which is accommodated within the back sound chamber 714 that is formed in lower shell portion 704. Electrical connections 718 connect electret diaphragm 710 and back electrode 712 to other hearing instrument components (not shown).

The embodiments shown in FIGS. 16–21 illustrate that many different loudspeaker types can be utilized when the hearing instrument receiver is integrated into the hearing instrument housing.

According to another preferred aspect of the invention, it is desirable to provide a "one size fits all" peritympanic hearing instrument. It has been discovered that the inclusion of a tip that can sustain large elastic deformations is quite beneficial. A major advantage of this type of tip is that it allows deep penetration into the ear canal by the hearing instrument. Without such penetration, the development of an improved prosthetic device that occupies the peritympanic region would be difficult at best.

Several important advantages are conferred by the utilization of a hearing aid that allows large elastic deformations. The flexible tip enables the navigation of the typical, nominally S-shaped centerline path of an ear canal. Post insertion, the stationary location of the flexible tip is between the second bend and the ear drum. In other words, the distal end of the tip of the hearing instrument has traversed both bends and has now entered the peritympanic region. By placing the tip so deeply into the ear, it is now possible to more efficiently couple the sound emitted from the receiver to the ear drum. Therefore, the required output levels of the receiver are reduced, and lower gain amplification may be used. The hearing instrument's battery capacity requirements are also reduced, resulting in a smaller battery and a smaller prosthesis.

The flexible tip also allows the generation of a seal in the bony region of the ear canal. It is believed that an appropriate seal in this region will substantially mitigate the occlusion effect—whereby low frequency signals and noise are overly pronounced. It is also noted that, if desired, the flexible tip may be designed as a replaceable part. Hence, if the tip were to become overly contaminated with wax, rather that attempting to clean it, one could simply remove the old tip and subsequently attach a new one. A wax guard, such as those described with reference to FIGS. 9 and 10, would obviate such replacement.

Figure 11:
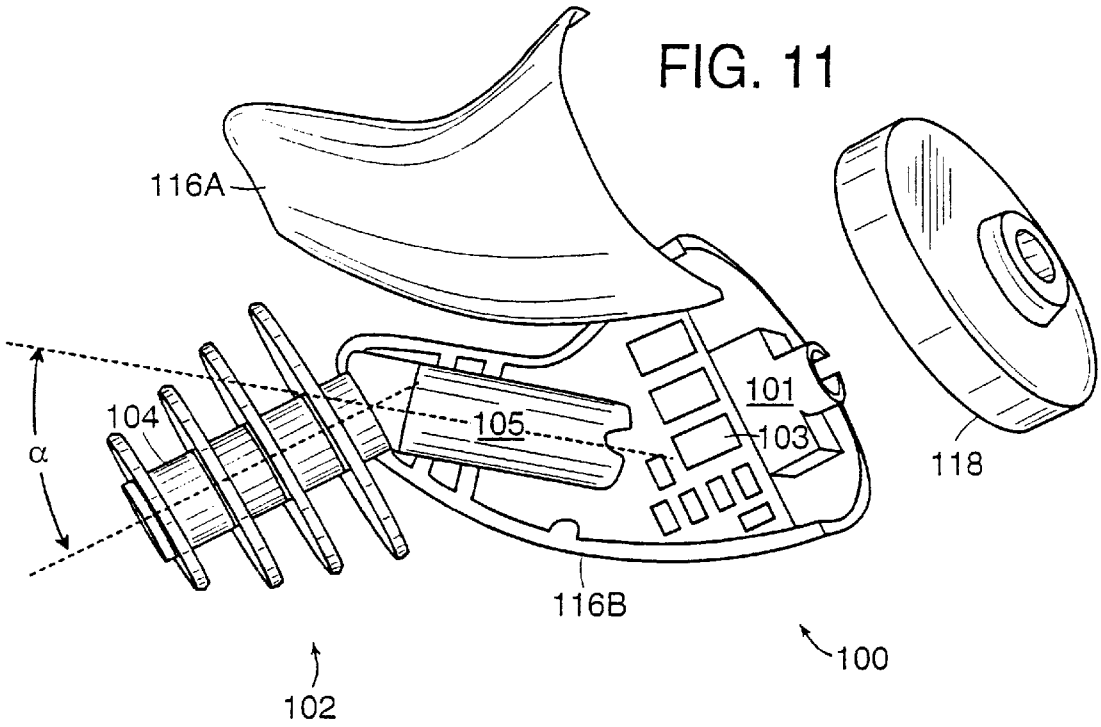
FIG. 11 is an exploded view of a hearing instrument including an embodiment of a tip assembly according to this invention.
Figure 12:
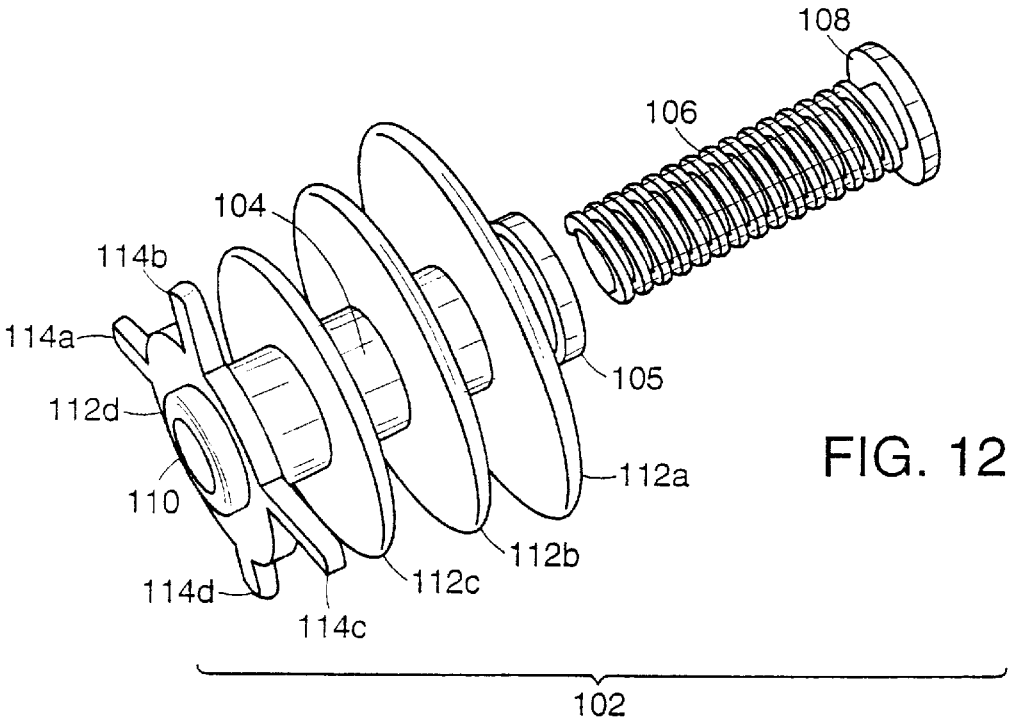
FIG. 12 is an exploded view of the tip assembly shown in FIG. 11.

The preferred hearing instrument 100 embodying this aspect of the invention is shown in FIGS. 11–12. Referring to those figures, the tip assembly 102 consists of a soft, low durometer covering (or hollow body) 104; an integral spring 106; and some means for retaining the tip assembly 102 in the body of the hearing instrument. In this instance, a retaining disk 108 that resembles a washer is attached to the spring 106 by a soldering, brazing, welding, or some other suitable joining process. Alternatively, a spring having an abrupt increase in diameter could be used for retention, thus eliminating the need for the retaining disk 108. This spring subassembly 106, 108 is then preferably inserted into a mold cavity, and the soft tip 104 is then injection molded around the spring insert. If desired, spring 106 could be used to form the threads shown in FIG. 2.

As shown in FIGS. 11 and 12, hollow body portion 104 of tip assembly 102 is substantially tubular in shape and is elongated for permitting a continuum of deformations along its length so that its axis can conform to the axis of the external auditory canal in the region adjacent to the tympanic membrane. The outer diameter of body 104 is preferably significantly smaller then its length to permit such deflection. The hollow body portion 104 includes a passage 110 that extends all the way through portion 104 as a channel for the communication of acoustic signals between the receiver and the tympanic membrane. Alternatively, passage 110 can terminate at a wax guard membrane as described previously with reference to FIGS. 9 and 10. The purpose of the soft outer covering 104 is to provide comfort to the wearer.

A series of radially outwardly extending rings or fins 112*a*–112*d* are positioned about the circumference of the body 104 to generate an acceptable acoustic seal. At least about four rings may be provided on the hollow body 104 although it is contemplated that fewer can be used. Rings 112*a*–112*d* are preferably provided with reducing outer diameters as they approach the distal end of hollow body portion 104. Such a construction provides various ring diameters so that at least one or two of the rings are appropriately sized to form a seal in the user's ear canal. Although many sizes are contemplated, one exemplary embodiment of tip assembly 102 has ring diameters of 7, 8, 9 and 10 mm, for example. Also, although the rings are illustrated as flat plates, the rings can also be contoured. For example, they can be angled away from the tympanic membrane to help guide the tip into the ear canal. Vent holes (not shown) can be provided in rings 112*a*–112*d* to vent pressure from the tympanic membrane to the atmosphere, although the compliance of the rings can make them self venting. Such a structure provides a series of seals against the inner canal surface and ensures that at least one will be appropriately sized to seal in a particular ear canal.

The distal-most ring 112*d* has the smallest diameter and it is provided with four centering protrusions 114*a*–114*d* that extending radially outwardly from the perimeter portion of ring 112*d*. Although four such protrusions are shown in the exemplary embodiment, fewer or more can be used as well. In any event, whatever quantity is selected, the protrusions are preferably spaced evenly about the ring's circumference.

It has been discovered that protrusions such as protrusions 114*a*–114*d* confer significant benefits. Specifically, they provide a means for centering the tip within the ear canal as it navigates toward the tympanic membrane. the protrusions 114*a*–114*d* glide along the inner surface of the canal and bend away from the direction of insertion, thereby centering hollow body 104 in the canal for optimal positioning and comfort.

Because the rings are thin and constructed of a low modulus, low durometer material, the tip assembly provides a high level of comfort for the user even when used in the bony region of the ear. The rings may be spaced apart from one another along the tip's length.

It has been discovered that tip assembly 102 is more comfortable than traditional custom ear molds. It is contemplated that a tip assembly according to this aspect of the invention can be used in conjunction with traditional hearing aids whether they are of the In-the-Ear (ITE), In-the-Canal (ITC), Completely-in-the-Canal (CIC), or Behind-the-Ear (BTE) type.

The integral spring 106 (FIG. 12) acts as a support that ensures that the tip's sound channel does not collapse when the tip assembly 102 is bent upon insertion by kinking or other deformation. Spring 106 is an example of one possible means for resisting such collapse. Other suitable supports can be substituted. Spring 106 is preferably a stainless steel or beryllium-copper compression spring that is helically wound. It can be replaced, however, with another form of spring such as a straight length of spring-tempered rod or a flat cantilever arm that extends along a length of the hollow body adjacent to the wall of the passage. Alternatively, spring 106 can be replaced by a metallic or plastic or elastic tube or tubular structure that is at least slightly more rigid than the remainder of the hollow body portion to resist the collapse of the passage upon bending. However, continuous tubing may tend to kink upon bending and such kinking could change or reduce the cross-section of the sound passage. The spring can also be replaced by a support in the form of a series of unconnected plastic, metallic or elastomeric rings that are embedded in the hollow body or otherwise positioned adjacent to the passage along the body's length to prevent excessive changes in the cross-sectional shape of the passage. Whatever form of support is selected, it is preferably adapted to permit the lengthwise angular deformation of the tip assembly while preventing or resisting undue kinking, deformation or collapse of the sound passage. Also, the support is preferably fully or partially embedded in the hollow body of the tip. If fully embedded, it is not exposed to the passage's interior. Alternatively, the support's inner surface can be flush with the passage's inner surface wall or can extend within the passage.

FIG. 11 depicts the flexible tip assembly incorporated into the hearing instrument 100. Instrument 100 includes two mating shell portions 116A and 116B and a proximal shell portion or end plate 118 at the opposite end from tip assembly 102. The distal end portions of shell portions 116A and 116B include semi-circular recesses, together defining a substantially circular opening when shell portions 116A and 116B are assembled, into which the proximal end of tip assembly 102 extends.

The diameter of the shell opening is slightly smaller than the diameters of retaining disk 108 and a flange 105 this is preferably located at the proximal end of hollow body portion 104. Accordingly, when shell portions 116A and 116B are mated together during assembly, flange 105 and retaining disk 108 are captured within the shell's interior to prevent inadvertent separation of tip assembly 102 from the shell. In other words, the tip assembly is retained due to the capture of the tip assembly's flange by the shell Because there is a retaining disk (or equivalent) and a flange, the tip assembly will be relatively difficult to remove from the shell. This is a safety feature that prevents the tip assembly from accidentally separating from the main hearing aid body.

Enclosed in assembled shell 116A, 116B are additional components of the hearing instrument, including a microphone 101, a circuit board 103, and a receiver 105.

Still referring to FIG. 11, another aspect of this hearing aid design is that the angle between the axis of the flexible tip 102 and the axis of the end portion of the shell has been selected to optimize the retention of the hearing aid in the ear canal.

Many conventional hearing aids tend to work their way out of the ear canal due to common activities of the user such as talking and chewing that can result in moving of the user's jaw. Flexible tip 102 is positioned past the second bend and tends to lock the hearing aid in position.

In order to help overcome this problem, the angle between the tip and body is preferably between about 20° and about 50° and is most preferably between about 36° and about 40°. An angle of about 380 is especially beneficial.

Figure 15:
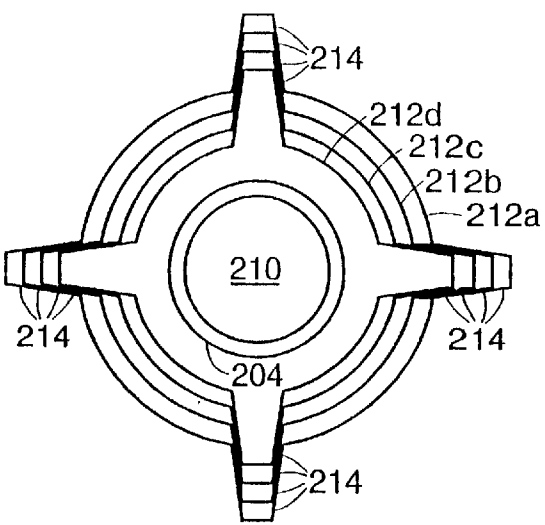
FIG. 15 is a distal end view of the tip assembly shown in FIG. 13.
Figure 13:
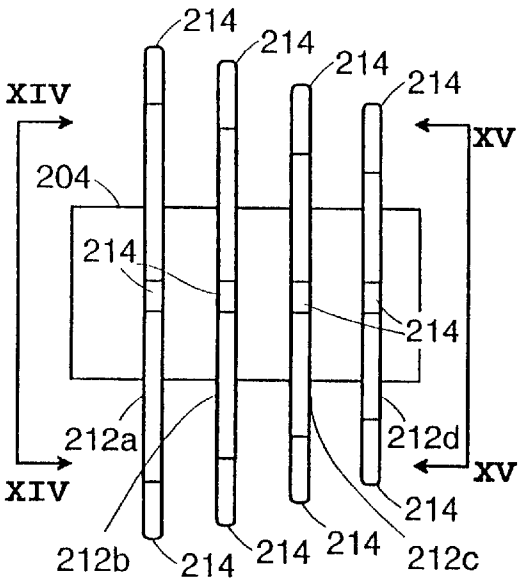
FIG. 13 is a side view of another embodiment of a tip assembly according to this invention.
Figure 14:
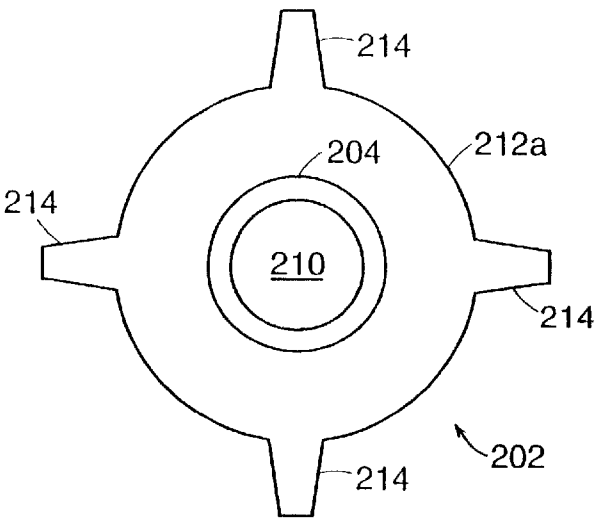
FIG. 14 is a proximal end view of the tip assembly shown in FIG. 13.

Referring now to FIGS. 13–15, another embodiment of a tip assembly is illustrated and is generally designated by the numeral "202. " It includes an elongated hollow body portion 204 that is substantially tubular along its length to define an elongated acoustic signal passage 210, which extends all the way through tip assembly 202 from its proximal end to its distal end or terminates at a wax guard membrane as described previously with reference to FIGS. 9 and 10. Tip assembly 202 includes a plurality of fins or rings 212*a*–212*d*, each of which extends radially outwardly from hollow body portion 204. Tip assembly 202 includes four such rings 212*a*–212*d* that are spaced at an equal distance along the length of hollow body portion 204. Around the outer circumference of each ring 212 are positioned four radially outwardly extending protrusions 214 which are spaced at equal distances about the perimeter of each ring 212*a*–212*d*.

As is most clearly illustrated in FIG. 15, the outer diameters of rings 212*a*–212*d* gradually increase from the smallest ring 212*d* which is positioned adjacent to the distal end of tip assembly 202. In this embodiment, each of the protrusions 214 have substantially the same length and extend to increasingly larger circumferential positions as the diameters of the respective rings on which they are mounted enlarge.

As with the previous embodiment of the tip assembly 102, the rings 212*a*–212*d* are provided on tip assembly 202 in order to ensure a seal between the tip assembly and the inner surface of the user's external auditory canal. Also, protrusions 214 act to center the tip assembly 202 within the ear canal as it is inserted toward the tympanic membrane so that the passage 212 and the hollow body portion 204 remain centered within the canal.

Although the invention has been described with reference to particular embodiments selected for illustration, it will be appreciated that many modifications can be made without departing from the spirit or scope of the invention.

Although it may be preferred to provide a tip portion having a predefined single or multiple degree-of-freedom joint for connection to the body of the hearing instrument, it should be appreciated that such a joint can be eliminated in its entirety and that a flexible tip member having a hollow body portion capable of significant deformation along its length can be used in order to conform the hearing instrument to the individual's external auditory canal. If a joint is used, it is preferably adapted to be positioned in the vicinity of the canal's second bend, but can be positioned elsewhere within the ear canal, as desired. A ball and socket style joint can be used but other known joints can be substituted depending on the application. If indeed a ball and socket joint is used, then the ball is optionally positioned on the hearing instrument's shell or on the instrument's tip. Similarly, the socket of the joint can be positioned on either one of the instrument's tip or shell components.

A wide variety of materials can be selected for use in forming the flexible tip member and the relatively rigid shell. Preferred materials have been described but they can be replaced with equivalent materials that can be selected at the discretion of the manufacturer of the hearing instrument. The tip of the hearing instrument is preferably provided with a guard or membrane in order to resist the ingress of cerumen into the acoustic signal passage; nevertheless, such a guard or membrane can be eliminated and the tip can simply be cleaned or replaced with a new tip periodically at the user's discretion.

The fins or rings positioned on the hollow body member can be provided in any quantity and size although it is preferred that they are designed in order to maintain an adequate seal between the tip and the inner surface of the user's canal. Similarly, the protrusions or flanges that extend outwardly from the hollow body portion or from the fins can be provided in any number in each plane or along the length of the hollow body portion, or they can be eliminated entirely.

Several specific types of receivers and receiver components have been described for the purpose of illustration but it will be appreciated that the disclosed components can be substituted for equivalent components. Also, the various manufacturing processes that are described herein for the assembly of the hearing instrument as well as the method of producing the various components (i.e., by injection molding, for example) can be substituted with equivalent assembly and manufacturing processes.

It will be appreciated that the spring 106 described as part of the tip assembly 102 is one example of a means for resisting or preventing the collapse of the passage to the hollow body portion. It will be appreciated that many alternative means can be substituted including tubular structures, spaced ring segments, cantilever lengths of spring-tempered materials, a structural support extending across the passage, or other structures that are capable of resisting an excessive change in the cross-sectional shape of the passage along its length that would otherwise occur upon bending of the hollow body portion as it is inserted into the user's ear canal.

Additional modifications are contemplated and the substitution of components for equivalent components and features is intended to be within the scope of the invention as it is defined in the appended claims.

What is claimed is:

1. A hearing instrument positionable in the external auditory canal proximal to the tympanic membrane, wherein the external auditory canal includes a proximal bend and a distal bend located between said proximal bend and the tympanic membrane, said hearing instrument comprising:

a substantially rigid shell shaped to enclose a microphone and a receiver, said shell having a distal end portion positionable to extend toward the tympanic membrane;

a relatively flexible tip member connected adjacent to said distal end portion of said shell, said tip member comprising a hollow body portion defining an elongated passage extending between proximal and distal end portions of said hollow body portion for permitting the communication of acoustic signals through said tip member between said shell and the tympanic membrane, wherein said hollow body portion of said tip member is sufficiently deformable so that an axis of said elongated passage substantially conforms to an axis of the external auditory canal upon insertion therein, and wherein said hollow body portion of said tip member is sufficiently rigid to resist substantial collapse of said elongated passage upon said insertion, said tip member further comprising an outer surface positioned to create a seal against an inner surface of the external auditory canal;

wherein said axis of said elongated passage defined by said hollow body portion of said tip member is moveable at an angle with respect to an axis of said shell such that said hearing instrument can navigate the path of the external auditory canal during insertion of a distal end of said tip member toward the tympanic membrane and beyond the distal bend of the external auditory canal.

2. The hearing instrument defined in claim 1, further comprising a joint positioned for connection between said distal end portion of said shell and a proximal end portion of said tip member, said joint permitting rotation of said axis of said elongated passage defined by said hollow body portion of said tip member with respect to said axis of said shell, wherein said rotation is about a rotation axis that is predefined by said joint.

3. The hearing instrument defined in claim 1, wherein said receiver comprises a motor and a diaphragm and wherein said shell comprises an interior surface shaped to enclose said motor and said diaphragm, thereby eliminating a separate receiver housing for enclosing said motor and said diaphragm.

4. The hearing instrument defined in claim 1, said outer surface of said tip member comprising a plurality of protrusions attached adjacent to said hollow body portion and extending radially outwardly from said hollow body portion, wherein a perimeter portion of each of said protrusions is positionable against said inner surface of the external auditory canal to center said tip member in the external auditory canal as it is inserted.

5. The hearing instrument defined in claim 1, said shell comprising shell portions each having an engagement surface extending toward said distal end portion of said shell, wherein said shell portions are assembled along said engagement surface to enclose said microphone and said receiver.

6. The hearing instrument defined in claim 1, said tip member further comprising a surface positioned adjacent to said distal end portion of said hollow body portion and traversing said elongated passage to prevent undue ingress of cerumen from the external auditory canal into said elongated passage.

7. The hearing instrument defined in claim 1, said hollow body portion of said tip member comprising a support positioned adjacent to said elongated passage for resisting said substantial collapse of said elongated passage upon said insertion.

8. A hearing instrument positionable in the external auditory canal of a human proximal to the tympanic membrane, wherein the external auditory canal includes a proximal bend and a distal bend located between said proximal bend and the tympanic membrane, said hearing instrument comprising:

a flexible tip comprising a hollow body portion defining an elongated passage extending between proximal and distal end portions of said hollow body portion for the communication of acoustic signals through said tip, said tip comprising an outer surface positioned to create a seal against an inner surface of the external auditory canal, said tip further comprising a plurality of protrusions attached adjacent to said hollow body portion and extending radially outwardly from said hollow body portion;

wherein a perimeter portion of each of said protrusions is positionable against said inner surface of the external auditory canal to center said tip in the external auditory canal and to help navigate said hearing said hearing instrument through the path of the external auditory canal during insertion of a distal end of said tip toward the tympanic membrane and beyond the distal bend of the external auditory canal.

9. The hearing instrument defined in claim 8, wherein said protrusions are positioned in a plane about a circumference of said tip.

10. The hearing instrument defined in claim 8, wherein said protrusions are positioned in planes axially spaced along the length of said tip.

11. The hearing instrument defined in claim 8, wherein said hollow body portion of said tip comprises a circumferential fin extending radially outwardly from said hollow body portion, and wherein said protrusions extend radially outwardly from a perimeter portion of said circumferential fin.

12. The hearing instrument defined in claim 8, wherein said tip is at least partially formed from an elastic material having a durometer of about 5 on a Shore A scale and a modulus of elasticity less than about 500 psi.

13. A hearing instrument positionable in the external auditory canal of a human, said hearing instrument comprising:

a flexible tip comprising a hollow body portion defining an elongated passage extending between proximal and distal end portions of said hollow body portion for the communication of acoustic signals through said tip, said tip further comprising a surface positioned adjacent to said distal end portion of said hollow body portion and traversing said elongated passage to resist ingress of cerumen from the external auditory canal into said elongated passage.

14. The hearing instrument defined in claim 13, said surface comprising a thin and flexible membrane extending across said elongated passage to prevent said ingress of cerumen, said membrane being of a thickness to permit transmission of acoustic signals across said membrane between the external auditory canal and the interior of said elongated passage.

15. The hearing instrument defined in claim 14, wherein said membrane is substantially acoustically transparent.

16. The hearing instrument defined in claim 13, further comprising a compliant surround for connection of said surface to said distal end portion of said hollow body portion.

17. The hearing instrument defined in claim 13, wherein said surface provides an acoustic filter.

18. A hearing instrument positionable in the external auditory canal of a human proximal to the tympanic-membrane, wherein the external auditory canal includes a proximal bend and a distal bend located between said proximal end and the tympanic membrane, said hearing instrument comprising:

a substantially rigid shell having a distal end portion positionable to extend toward the tympanic membrane; and a relatively flexible tip member connected adjacent to said distal end portion of said shell, said tip member comprising a hollow body portion defining an elongated passage extending between proximal and distal end portions of said hollow body portion for permitting the communication of acoustic signals through said tip member between said shell and the tympanic membrane, wherein said hollow body portion of said tip member is sufficiently deformable so that an axis of said elongated passage substantially conforms to an axis of the external auditory canal upon insertion therein, said tip member further comprising a support positioned along a length of said hollow body portion and extending adjacent to said elongated passage for resisting substantial collapse of said elongated passage upon said insertion.

19. The hearing instrument defined in claim 18, wherein said support is selected from a group consisting of a spring and a ring positioned adjacent to a wall of said elongated passage.

20. The hearing instrument defined in claim 18, wherein said hollow body portion is molded around said support.

21. A tip adapted for use with a hearing instrument and intended to be positioned in the external auditory canal of a human proximal to the tympanic membrane, said tip comprising:

a hollow body defining an elongated passage extending between proximal and distal end portions thereof for permitting the communication of acoustic signals through said tip, said hollow body being sufficiently deformable to permit an axis of said elongated passage to conform to an axis of the external auditory canal along the length of said hollow body upon insertion;

a spring extending at least partially along a length of said hollow body and positioned adjacent to said elongated passage, said spring being sufficiently flexible to permit said axis of said elongated passage to conform to said axis of the external auditory canal and sufficiently rigid to resist substantial collapse of said elongated passage upon said insertion.

22. The tip defined in claim 21, wherein said spring is selected from a group consisting of a compression spring and a cantilever spring.

23. A method of assembling a hearing instrument having a shell shaped to fit comfortably into the external auditory canal of a human and sized to enclose internal hearing instrument components, said method comprising the steps of:

(a) providing shell portions each having a proximal and distal end portion and an engagement surface extending between said proximal and distal end portions along a length of said shell portions, said shell portions each having internal surfaces positioned to define internal compartments when said shell portions are aligned with one another;

(b) inserting said internal hearing instrument components into at least one of said shell portions;

(c) aligning said shell portions with one another to match said internal surfaces and to define said internal compartments; and (d) mating said shell portions along said engagement surfaces to enclose said internal hearing instrument components.

24. The method defined in claim 23, wherein said internal hearing instrument components include a receiver comprising a motor and a diaphragm, and wherein said inserting step further comprises inserting said motor and said diaphragm in different shell portions.

25. The method defined in claim 24, wherein said aligning step further comprises aligning said motor and said diaphragm for connection to one another.

* * * * *

UNITED STATES PATENT AND TRADEMARK OFFICE

CERTIFICATE OF CORRECTION

PATENT NO. : 6,205,227 B1 
DATED : March 20, 2001
INVENTOR(S) : Derek Dwayne Mahoney, Marvin Allan Leedom, John Michael Margicin and Walter Paul Sjursen It is certified that error appears in the above-identified patent and that said Letters Patent is hereby corrected as shown below:

Column 19,
Line 60, delete "said hearing" (second occurrence).

Signed and Sealed this

Fourth Day of June, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,205,227 B1
APPLICATION NO. : 09/105729
DATED : March 20, 2001
INVENTOR(S) : Derek Dwayne Mahoney et al.

It is certified that error appears in the above-identified patent and that said Letters Patent is hereby corrected as shown below:

In column 8, line 15, delete “complaint” and insert --compliant--;

In column 8, line 38, delete “complaint” and insert --compliant--;

In column 9, line 15, delete “complaint” and insert --compliant--;

In column 10, line 38, delete “complaint” and insert --compliant--;

In column 10, line 40, delete “Complaint” and insert --Compliant--.

Signed and Sealed this

Seventeenth Day of July, 2007

JON W. DUDAS
*Director of the United States Patent and Trademark Office*